US005766429A

United States Patent [19]

Shimamune et al.

[11] Patent Number: 5,766,429

[45] Date of Patent: Jun. 16, 1998

[54] ELECTROLYTIC CELL

[75] Inventors: Takayuki Shimamune, Tokyo; Yoshinori Nishiki; Takahiro Ashida, both of Kanagawa; Yasuo Nakajima, Tokyo, all of Japan

[73] Assignee: Permelec Electrode Ltd., Kanagawa, Japan

[21] Appl. No.: 659,242

[22] Filed: Jun. 5, 1996

[30] Foreign Application Priority Data

Jun. 5, 1995 [JP] Japan ..... 7-161479

[51] Int. Cl.[6] ..... C25B 9/00; C25B 9/04; C25B 15/08

[52] U.S. Cl. ..... 204/257; 204/263; 204/282; 204/283

[58] Field of Search ..... 204/282, 283, 204/258, 266, 252, 257, 263

[56] References Cited

U.S. PATENT DOCUMENTS 3,168,458 2/1965 Sprague ..... 204/283 X
3,930,151 12/1975 Shibata et al. ..... 204/283 X
3,989,615 11/1976 Kiga et al. ..... 204/283 X
4,332,662 6/1982 Pouli et al. ..... 204/283 X

*Primary Examiner*—Donald R. Valentine
*Attorney, Agent, or Firm*—Sughrue, Mion, Zinn, Macpeak & Seas, PLLC

[57] ABSTRACT

An electrolytic cell for producing sodium hydroxide, etc., which is partitioned by an ion-exchange membrane into an anode chamber and a cathode chamber, wherein at least one of a anode and a cathode is closely contacted to the ion-exchange membrane to form a gas diffusion electrode, and a current supplying means having guides for removing sodium hydroxide, etc., formed at the surface of the gas diffusion electrode is disposed therein closely contacting the gas diffusion electrode.

By having a current supplying means having removing guides, sodium hydroxide formed at the surface of the gas diffusion electrode is separated therefrom and removed, whereby the supply of the raw material gas and removal of the produced gas can be smoothly performed without clogging perforations of the gas diffusion electrode with the sodium hydroxide.

4 Claims, 2 Drawing Sheets

ELECTROLYTIC CELL

FIELD OF THE INVENTION

The present invention relates to an electrolytic cell using a gas diffusion electrode, and more specifically to an electrolytic cell for, for example, a chloroalkali using a gas diffusion electrode.

BACKGROUND OF THE INVENTION

Industrial electrolysis such as caustic alkali electrolysis, performs an important role in material industries. However, the energy required for such electrolysis is large. Since the energy cost for such electrolysis is great, conservation is an important objective. In caustic alkali electrolysis, the electrolytic method may be converted from a mercury method to an ion-exchange membrane method through a diaphragm method, and by the conversion, energy savings of about 40% may be attained. However, even this energy savings is insufficient since electric power is about 50% of the total production cost. Current electrolytic techniques make it impossible to save a more energy.

For further energy conservation, a gas diffusion electrolysis which has been investigated and developed in the field of electrolytic cells such as fuel cells has been attempted. When a gas diffusion electrode is applied to an ion-exchange membrane-type sodium chloride electrolysis wherein energy savings is greatest at present, energy savings of more than 50% becomes possible as demonstrated in the formula below. Accordingly, many attempts have been made to use a gas diffusion electrode for electrolyses.

$$2NaCl + 2H_2O \longrightarrow Cl_2 + 2NaOH + H_2 \quad E_o = 2.21\ V$$

$$2NaCl + 1/2O_2 + H_2O \longrightarrow Cl_2 + 2NaOH \quad E_o = 0.96\ V$$

The structure of the gas diffusion electrode used for caustic alkali electrolysis is a semi-hydrophobic (water repellent) type and has a structure such that a hydrophilic reaction layer is adhered to a water repellent gas diffusion layer. The energy savings from the materials of these gas diffusion electrodes is enhanced and results in a reduction of the cell voltage.

On the other hand, the energy savings from the structure of the above gas diffusion electrode has also been investigated, and the reduction of the bath voltage has also been attained by closely contacting or adhering the ion-exchange membrane to the gas diffusion electrode. According to the structure, caustic soda (sodium hydroxide) formed at a gas diffusion cathode is removed to a cathode chamber (gas chamber) side through the reaction layer and the gas diffusion layer. For permeating the sodium hydroxide through the gas diffusion layer, it is necessary to control the size and the distribution of the perforations (holes) of the gas diffusion layer. In such a structure, since the pressure difference is not influenced by the height direction of the gas chamber side, it is unnecessary to consider the pressure distribution even when the electrolytic cell is high. Further, the electric resistance of the sodium hydroxide solution (catholyte) is minimized whereby the cell voltage may be kept low. However, the structure has the disadvantage that the sodium hydroxide permeated to the gas chamber side may remain at the surface of the gas diffusion electrode and clog the perforations of the gas diffusion layer. This disadvantage becomes particularly severe in a large practical electrolytic cell. That is, the supply of the raw material gas and removal of the gas thereby produced are obstructed. As a result, the electric current distribution may become non-uniform and the cell voltage may increase. This is a major problem for producing large electrolytic cells.

According to the inventors' research, when electrolysis is carried out using a small experimental electrolytic cell having a diameter of about 5 cm, the current density is 30 $A/dm^2$, and the bath voltage is from 2 to 2.2 volts. However, when the height of the electrolytic cell is increased to about 25 cm in order to increase the electrolytic area, the cell voltage becomes higher than 2.5 volts. Furthermore, when the size of the electrolytic cell is further increased, it becomes impossible to carry out electrolysis at a current density of 30 $A/dm^2$. The reason is that sodium hydroxide, etc., formed thereby covers the surface of the gas diffusion electrode and clogs the pores. As a result, the gas supply is obstructed. This problem may not be solved by controlling the wettability of the gas supplying surface.

SUMMARY OF THE INVENTION

An object of the present invention is to provide an electrolytic cell, in particular a chloroalkali electrolytic cell using a gas diffusion electrode which solves the problems remaining in conventional techniques. That is an object of the present invention is to prevent an electrolyte such as sodium hydroxide, etc., from covering the surface of the gas diffusion electrode, whereby supply of the raw material gas and removal of the gas produced cannot be smoothly performed.

According to the present invention, there is provided an electrolytic cell characterized in that it is partitioned by an ion-exchange membrane into an anode chamber and a cathode chamber, at least one of the anode and the cathode is closely contacted with the ion-exchange membrane to form a gas diffusion electrode, and a current supplying means having one or more guide(s) for removing the formed electrolyte covering the surface of the gas diffusion electrode are disposed in a state such that they closely contact with the gas diffusion electrode so that at least a part of the formed electrolyte is separated from the gas diffusion electrode using the removing guide(s).

DETAILED DESCRIPTION OF THE INVENTION

Figure 1:
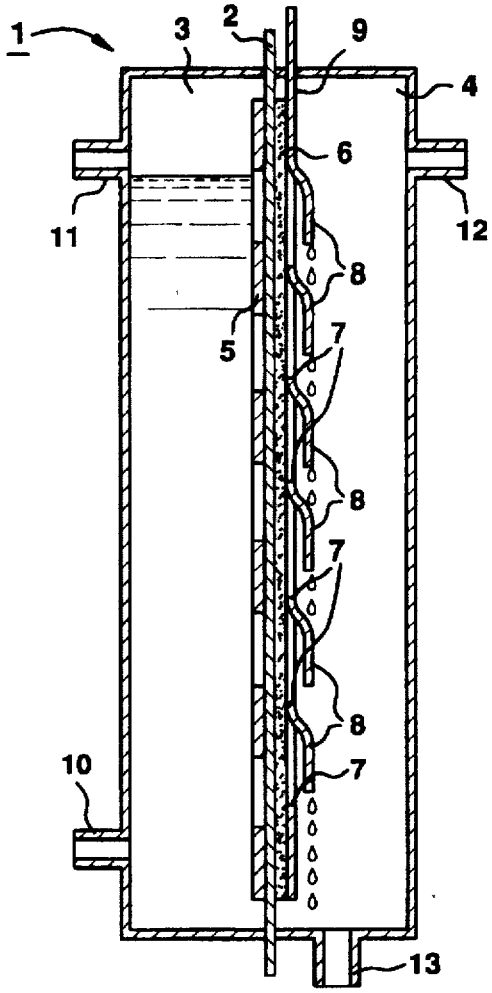
FIG. 1 is schematic cross sectional view showing one example of the electrolytic cell of the present invention.

The present invention is described in detail below.

In the present invention, a current supplying means which functions to remove the formed electrolyte such as a louver is situated close to the surface of a gas diffusion electrode at the opposite side of an ion-exchange membrane. The surface of the gas diffusion electrode is subject to being covered with an electrolyte permeated through the gas diffusion layer. The electrolyte reaching the surface of the gas diffusion electrode is brought into contact with the louver, etc., is passed downward by utilizing the inclination of the louver, etc., and is separated from the surface of the gas diffusion electrode. Thereby covering of the surface of the gas diffusion electrode and clogging of the perforations of the gas diffusion electrode with the electrolyte are prevented. Thus, supply of the raw material gas and removal of the gas thereby formed is accomplished smoothly. Non-uniformity of the electric current distribution and increase of the cell voltage, which may occur in large-sized electrolytic cells, are prevented.

There is no particular restriction on the gas diffusion electrode used for the electrolytic cell of the present invention. For example, a gas diffusion electrode comprising a reaction layer and a gas diffusion layer may be used. It is desirable that in the gas diffusion layer of the gas diffusion electrode, for retaining the water repellency, the amount of a fluorinated hydrocarbon such as PTFE resin be increased to about 60 to 70%. On the other hand, in the reaction layer, the content of the fluorocarbon compound is preferably from about 35 to 45% in order to retain proper water repellency and a hydrophilic property.

The reaction layer described above may be formed with carbon such as carbon black, and a binder for imparting water repellency as usual, or it may be formed with a kneaded mixture of silver and a fluorocarbon compound such as a PTFE resin. The reason for adding the fluorocarbon compound is that although the PTFE resin is water repellent, the resin may become hydrophilic in a high-concentration alkali. The PTFE resin does not become hydrophilic when the fluorocarbon compound is present.

On the other hand, the gas diffusion layer may be made from a kneaded mixture of carbon and a PTFE resin as usual without considering the corrosion of the layer. However, as a matter of course silver may be used as the reaction layer described above. Also, for obtaining a higher water repellency, a water repellent material may be attached to or mixed with the gas diffusion electrode by a suspension plating method, a thermal decomposition method, or a method of intermixing and sintering silver. In addition, a protective layer for more effectively preventing the gas diffusion layer from becoming hydrophilic may be formed on the surface of the gas diffusion layer.

There is no particular restriction on the methods of forming the reaction layer and the gas diffusion layer. It is not necessary to use a complicated method of sintering metallic silver alone. The layer may be prepared by the same method as the method of hardening carbon with a binder as in a conventional gas diffusion electrode, and the layer may be sintered by hot pressing, etc.

In the present invention, a current supplying means functioning to supply an electric current and to remove an electrolyte formed is closely disposed on the surface of the opposite side of the gas diffusion electrode on the side to which the ion-exchange membrane is closely contacted, usually the gas diffusion layer side. Since the current supplying means aims to quickly remove a liquid product from the surface of the gas diffusion electrode to allow smooth supply of the raw material gas and removal of the gas thereby produced, it is sufficient for the current supplying means to be disposed at the gas chamber side only, in which the liquid is formed. That is, when the electrolytic cell of the present invention is used as a chloroalkali electrolytic cell it is almost meaningless to dispose the current supplying means at the anode chamber side since at this side, only a chlorine gas is formed and there is no liquid produced. On the other hand, in the cathode chamber, sodium hydroxide is obtained as the liquid and since the sodium hydroxide covers the surface of the gas diffusion electrode to obstruct the supply of an oxygen-containing gas, by disposing the current supplying means at this side, the liquid sodium hydroxide may be brought into contact with the louver, etc., of the current supplying means and removed to improve the electrolysis efficiency.

It is preferred that the current supplying means has a form so that it is in contact with only a portion of the surface of the gas diffusion electrode so that supply of the raw material gas can be smoothly performed. For example, porous materials such as expanded meshes, etc., or a plurality of narrow plates or a plurality of rods may be disposed with a proper distance between them. Furthermore, a plurality of cuts may be formed in a tabular material, and the cuts may be projected in the same direction in a louver form.

The current supplying means needs guide(s) for removing the electrolyte permeating from the ion-exchange membrane side through the gas diffusion electrode. The guide(s) function to bring the electrolyte into contact therewith, move downward, and remove the electrolyte from the surface of the gas diffusion electrode. Thus, the guides must be slanted downward. In the case of a plurality of narrow-wide plates or a plurality of rods described above, they may be disposed in contact with the gas diffusion electrode in a slanted position. When the cuts formed in the tabular material are projected, the cuts formed downward may be projected such that each tip thereof slants downward. In the case of using an expanded mesh, a plurality of rods, etc., described above may be equipped on the surface thereof, or louvers may be separately prepared, and they may be adhered to the surface thereof.

When a plurality of removing guides are formed, if the interval between the adjacent guides is too small, the electrolyte formed remains between both guides. Thus, it is preferred that the interval is from 5 to 100 mm.

It is desirable for the current supplying means to be formed from a material comprising copper, nickel, silver, or an alloy. When the current supplying means is formed by a material other than silver, it is preferred to coat the surface thereof with silver.

In addition, since the electrolyte formed may move downward while in contact with the guide, the guide may not only be slanted but also hang down. It is desirable for the lower end of the guide to be formed at an acute angle such that the formed electrolyte reaches the lower end of the guide may be dropped or flow down from the lower end.

In an electrolytic cell, in particular, a large-size industrial electrolytic cell using a gas diffusion electrode having a current supplying means equipped with such removing guide(s), the liquid product formed at the reaction layer of the gas diffusion electrode passes through the gas diffusion layer and remains at the surface of the gas diffusion electrode. Thereby non-uniformity of current distribution and increase of bath voltage may occur. However, the liquid product may be introduced at a lower portion from the surface of the gas diffusion electrode through the removing guide(s). Thereby the liquid product may be removed from the surface of the gas diffusion electrode. Accordingly, in the present invention, since the raw material gas can be smoothly supplied without the liquid product being retained at the surface of the gas diffusion electrode, the disadvantages of non-uniformity of the current distribution and increase of cell voltage occurring in the case of using a conventional gas diffusion electrode can be solved.

Figure 2:
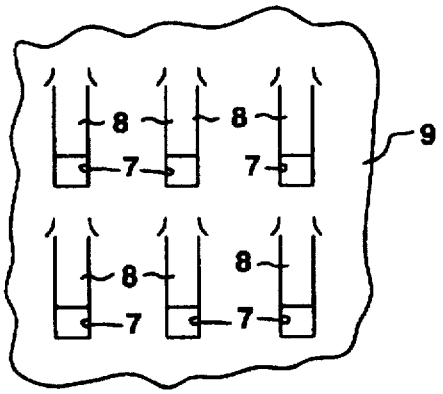
FIG. 2 is a partial side view of the current supplying means disposed in the electrolytic cell shown in FIG. 1.
Figure 3:
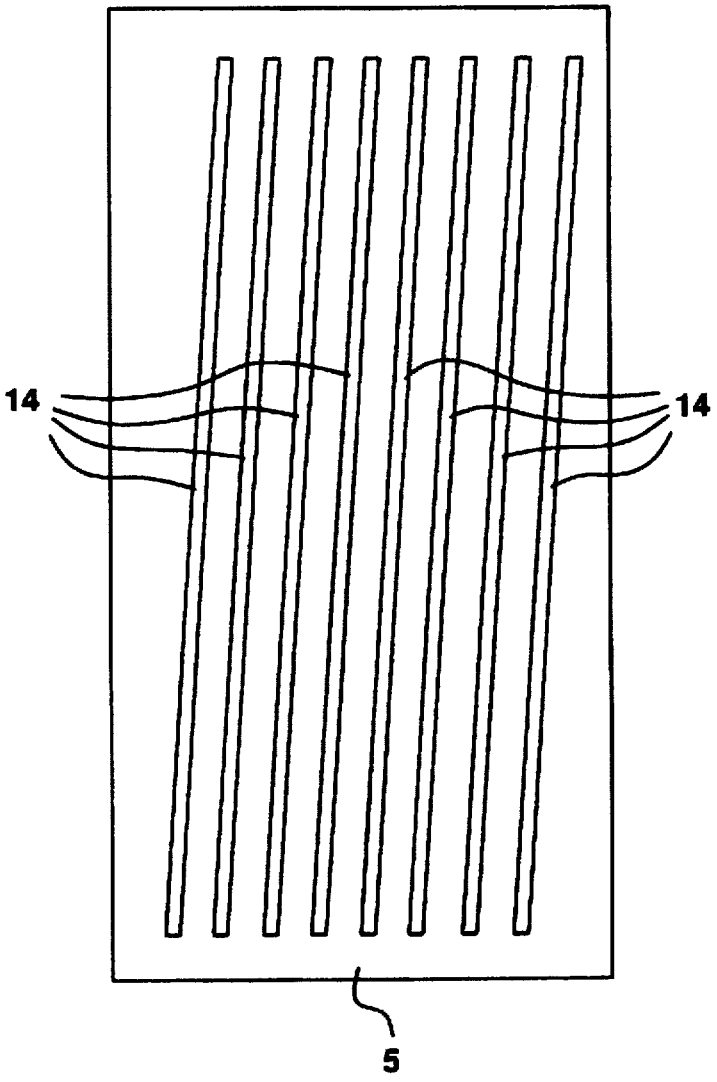
FIG. 3 is a side view showing one example of other current supplying means.

Turning now to the figures, FIG. 1 is a schematic cross sectional view showing one example of the electrolytic cell, FIG. 2 is a partial side view of the current supplying means used in the electrolytic cell shown in FIG. 1, and FIG. 3 is a side view showing an example of other current supplying means used in the present invention.

As shown in FIG. 1, an electrolytic cell 1 is partitioned by an ion-exchange membrane 2 into an anode chamber 3 and a cathode chamber 4. In the cathode chamber 3 is disposed dimensionally stable anode 5 comprising an expanded mesh closely contacting ion-exchange membrane 2, and in the cathode chamber 4 is disposed a gas diffusion cathode 6 comprising a reaction layer and a gas diffusion layer closely contacting ion-exchange membrane 2.

To the gas diffusion cathode 6 is installed a tabular current supplying means 9, at which a plurality of louvers 8 formed by outwardly projecting cuts 7 are formed lengthwise and crosswise with an interval among each other closely contacting the gas diffusion cathode 6.

At the side wall of the lower portion and the side wall of the upper portion of the anode chamber 3 are formed an anolyte inlet 10 and an anolyte outlet 11, respectively, and at the side wall of the upper portion and the bottom of the cathode chamber 4 are formed an oxygen gas-containing gas inlet 12 and a sodium hydroxide outlet 13.

When an electric current is passed through both electrodes while supplying an aqueous solution of sodium chloride to the anode chamber 3 of the electrolytic cell 1 and an oxygen-containing gas to the cathode chamber 4, hydrogen gas is formed in the anode chamber and sodium hydroxide is formed near the ion-exchange membrane 2 of the gas diffusion cathode 6. The sodium hydroxide passes through the gas diffusion cathode 6 and reaches the current supplying means 9 side of the gas diffusion cathode 6. The sodium hydroxide is brought into contact with the louvers 8, flows down along the surface of each louver 8 in conformity with the inclination of the louvers 8, falls down from the lower end of each louver 8, and is removed from the bottom of the electrolytic cell 1. Accordingly, the surface of the gas diffusion cathode 6 is not covered with the sodium hydroxide formed and even with a large electrolytic cell, the problems of non-uniformity of current distribution and reduction of cell voltage do not occur.

The louvers shown in FIG. 2 may be replaced with a plurality of rods 14, which function as a current supplying means, directly disposed on the surface of the gas diffusion cathode 6 as shown in FIG. 3. Even in this case, the sodium hydroxide which reaches the gas diffusion cathode 6 is brought into contact with the rods 14, flows down along the rods 14, and is removed from the surface of the gas diffusion cathode 6.

Examples of electrolysis using the electrolytic cell of the present invention are described below, but the invention is not limited by those examples. Unless otherwise indicated, all parts, percents, ratios and the like are by weight.

EXAMPLE 1

A silver foam having a thickness of 1 mm and having perforations of porosity of 90% and a pore diameter of from 0.2 to 1 mm was used as a substrate. A silver paste prepared by kneading a suspension of a silver powder having a particle size of from 1 to 5 μm and a PTFE resin was coated on one surface of the substrate followed by baking at 350° C. for 10 minutes. An aqueous solution of chloroplatinic acid was then coated on the surface followed by heating to 250° C. while flowing a 1:1 mixed gas of hydrogen and argon, to obtain a gas diffusion electrode having platinum thereon.

The gas diffusion electrode was disposed in a cathode chamber of a sodium chloride electrolytic cell (height 25 cm, width 5 cm)-partitioned by a cation-exchange membrane (Nafion 90209, made by E.I. du Pont de Nemours and Company) into an anode chamber and a cathode chamber in such a manner that a reaction layer side having the silver described above faced the cation-exchange membrane. A dimensionally stable anode composed of a titanium expanded mesh having a thickness of 0.5 mm having ruthenium oxide thereon was used as an anode.

Cuts having a louver form each having a width of 5 mm, a pitch of 10 mm, and a length of 10 mm were formed in a silver plate having a thickness of 1 mm and were provided as a current supplying means. The louver cuts were formed in the height direction of the silver plate with an interval of 25 mm, and each tip of the louver cut was slanted downward at an angle of 60° to the surface of the electrode.

Electrolysis was then carried out at a current density of 30 $A/dm^2$ while supplying an oxygen gas saturated with water to the cathode chamber of the electrolytic cell and 200 g/liter of an aqueous sodium chloride solution to the anode chamber. The cell voltage observed was 2.1 volts, 35% sodium hydroxide was obtained, and the current efficiency was from 93 to 95%.

COMPARATIVE EXAMPLE 1

When electrolysis was carried out under the same conditions as in Example 1 except that a silver-plated nickel expanded mesh having a thickness of 0.5 mm and a porosity of 70% was used as the current supplying means at the cathode side in place of a plurality of silver plates, the cell voltage was over 2.7 volts, electrolysis was not carried out in a stable manner, and the electrolysis could not be continued without lowering the current density. This was caused by a thin sodium hydroxide film attached to the opposite surface of the gas diffusion electrode to the ion-exchange membrane side, whereby smooth supply of oxygen gas was prevented.

EXAMPLE 2

Electrolysis was carried out under the same conditions as in Example 1 except that the interval between the silver plates was changed. When the interval was 5 mm, the cell voltage was 2.5 volts and a part of the sodium hydroxide formed remained between the adjacent silver plates. When the interval of the silver plates was changed to from 10 to 50 mm, the cell voltage was kept in the range of from 2.05 to 2.1 volts. When the interval of the silver plates was changed to from 50 to 100 mm, the cell voltage was increased with the increase of the interval, and when the interval was 100 mm, a slight retention of sodium hydroxide formed at the back side of the electrode was observed. When the interval was longer than 100 mm, amount of sodium hydroxide obtained was further increased as was the cell voltage.

Thus, the present invention provides an electrolytic cell, wherein the electrolytic cell is partitioned by an ion-exchange membrane into an anode chamber and a cathode chamber, at least one of a cathode and an anode is closely contacted to the ion-exchange membrane to form a gas-diffusion electrode, and a current supplying means having guide(s) for removing a formed electrolysis covering the surface of the gas diffusion electrode are disposed in a state of closely contacting to the gas diffusion electrode such that at least a part of the formed electrolyte is separated from the gas diffusion electrode using the removing guide(s) and removed.

In the electrolytic cell of the present invention, the electrolyte formed such as sodium hydroxide which passes through the gas diffusion electrode and reaches the surface thereof is removed toward the lower portion in the electrolytic cell through the removing guide(s) without remaining at the surface of the gas diffusion electrode. Accordingly, the retention of the formed electrolyte, which retains at the surface of the gas diffusion electrode and clogs the perforations of the gas diffusion electrode to obstruct the supply of the raw material gas and removal of the produced gas in the case of lacking in the removing guide(s), is prevented by disposing the removing guide(s). Thereby, a uniform current distribution and lower cell voltage may be obtained.

As the removing guide(s) described above, a plate having louvers projected therefrom or a plate having disposed thereon a plurality of narrow-width plates or a plurality of rods in parallel may be used. In any case, retention of the formed electrolyte at the surface of the gas diffusion electrode is prevented.

Also, if the interval of the adjacent removing guides is too small, the formed electrolyte remains between the guides by the surface tension, while if the interval is too large, the effect of forming the guides is reduced. Accordingly, it is preferred that the interval of the removing guides be from 5 to 100 mm.

While the invention has been described in detail and with reference to specific embodiments thereof, it will be apparent to one skilled in the art that various changes and modifications can be made therein without departing from the spirit and scope thereof.

What is claimed is:

1. An electrolytic cell comprising an ion-exchange membrane partitioning the cell into an anode chamber and a cathode chamber, at least one of an anode and a cathode closely contacted to the ion-exchange membrane thereby forming a gas diffusion electrode, and a current supply element having at least one guide for removing an electrolyte covering the surface of said gas diffusion electrode disposed therein and closely contacting the gas diffusion electrode such that at least a part of the electrolyte is separated from the gas diffusion electrode by removing guides.

2. The electrolytic cell of claim 1, wherein the removing guides are louvers formed projectingly at a tabular current supplying means.

3. The electrolytic cell of claim 1, wherein the removing guides are a plurality of narrow-width plates or a plurality of rods disposed on the surface of the gas diffusion electrode in contact with the surface.

4. The electrolytic cell of claim 1 having a plurality of removing guides wherein the interval between adjacent removing guides is from 5 to 100 mm.

* * * * *